United States Patent [19]

Raque et al.

[11] Patent Number: 4,678,015

[45] Date of Patent: Jul. 7, 1987

[54] PRODUCT APPORTIONING SYSTEM

[75] Inventors: Glen F. Raque; Edward A. Robinson, both of Louisville, Ky.

[73] Assignee: Raque Food Systems, Inc., Louisville, Ky.

[21] Appl. No.: 847,487

[22] Filed: Apr. 3, 1986

[51] Int. Cl.[4] ..... B65B 3/04

[52] U.S. Cl. ..... 141/131; 141/137; 141/191; 141/232; 222/361

[58] Field of Search ..... 141/129–191, 141/231, 232, 233; 222/361

[56] References Cited

U.S. PATENT DOCUMENTS

| | | | |
|---|---|---|---|
| 2,257,347 | 9/1941 | Raymer | 141/131 |
| 4,197,794 | 4/1980 | Raque et al. | 141/131 |
| 4,490,961 | 1/1985 | Raque | 53/329 |

OTHER PUBLICATIONS

Model PF-2-5, and Model PF-2-2 Piston Filler Brochures, Raque Food Systems, Inc., on or before 1981.

*Primary Examiner*—Houston S. Bell, Jr.
*Attorney, Agent, or Firm*—Barnes & Thornburg

[57] ABSTRACT

An apportioning apparatus for depositing a selected amount of a particulate product onto a series of moving receptacles is provided. At least one bucket is mounted in a reciprocating carriage for receiving a selected amount of the product. The bucket includes a closure for the outlet end that selectively opens to deposite a selected amount of the product onto a moving receptacle, with the speed of movement of the carriage and bucket substantially matched to the speed of movement of the receptacle during the filling operation.

7 Claims, 3 Drawing Figures

PRODUCT APPORTIONING SYSTEM

The present invention relates to a system for filling individual containers. More particularly, the present invention relates to a system for metering a specified amount of a particulate material into a series of moving containers without slowing or otherwise interrupting the continuous movement of the containers.

Individual containers, especially the type that contain a single serving of food and sold either refrigerated or frozen, are becoming increasingly popular. Such containers are processed in an assembly line, with the filling of the containers usually accomplished by overhead spouts that disperse a metered amount of particulate food material into each individual container.

One problem with the known systems for filling the moving containers is that if anything more than a small amount of food material is to be placed in each container, the speed of movement of the line of containers must necessarily be slowed. The dispensing units of the known systems are generally small in size, and therefore are limited in the quantity of food material that can be dispensed in a short period of time. This restricts the speed of the individual containers which thus lowers the overall output per unit time of the system.

It is therefore one object of the present invention to provide a system for filling individual moving containers that is able to accurately fill such containers in rapid succession without the need to slow down the speed of movement of the containers.

According to the present invention, an apportioning apparatus for depositing a selected amount of a particulate product onto a series of moving receptacles is provided. The apparatus includes a frame having a carriage mounted for reciprocating movement thereon over the moving receptacles. At least one bucket is mounted on the reciprocating carriage that includes an inlet for receiving the particulate material and an outlet for depositing selectively the received particulate material onto the moving receptacles. The apparatus also includes means for closing the outlet of the bucket to retain the received particulate material and means for moving selectively the closing means to open the outlet of the bucket for a specified period of time so that the received food material is deposited in the moving receptacle. The apparatus also includes means for reciprocally driving the carriage between a first position where the bucket receives the particulate material and a second position where the bucket deposits the received material in the moving receptacle. The apparatus also includes first means for controlling the speed of movement of the reciprocating carriage such that the speed of the carriage substantially matches the speed of the moving receptacles near the second position and second means for controlling the means for moving the controlling means of the bucket so that the bucket outlet is open when the carriage is in the second position to deposit the particulate material in the receptacle.

One feature of the foregoing structure is that the bucket for receiving the material is mounted above the moving receptacles for reciprocating horizontal movement. The reciprocating movement is controlled such that the speed of the bucket substantially matches the speed of the moving receptacles near the position where the material will be deposited in the receptacle. One advantage of this feature is that the depositing operation can be accomplished without slowing the speed of movement of the moving receptacles.

Another feature of the present invention is that the means for moving the closing means of the bucket is controlled so that the bucket outlet does not open until the carriage and attached bucket have substantially matched the speed of the moving receptacles. One advantage of this feature is that there is no spillage of the particulate material onto the conveyor carrying the receptacles.

In preferred embodiments of the present invention, the apparatus includes a dispensing means for dispensing the particulate material into the at least one bucket.

Also in preferred embodiments of the present invention, the apparatus further includes two opposing blades that are mounted adjacent the outlet of the bucket and are movable between a confronting position and a spaced apart position and that cooperate to cover the outlet of the bucket when in the confronting position.

Also in preferred embodiments of the present invention, there are two buckets attached to the reciprocating carriage. One feature of this foregoing structure is that the buckets are mounted adjacent one another with their inlets contiguous. One advantage of this feature is that a single dispensing means can be used to fill both buckets. Another advantage of this feature is that two moving receptacles can be filled at the same time in one movement of the carriage, thereby increasing the efficiency of the filling operation.

Additional objects, features, and advantages of the invention will become apparent to those skilled in the art upon consideration of the following detailed description of a preferred embodiment exemplifying the best mode of carrying out the invention as presently perceived. The detailed description particularly refers to the accompanying figures in which.

Figure 1:
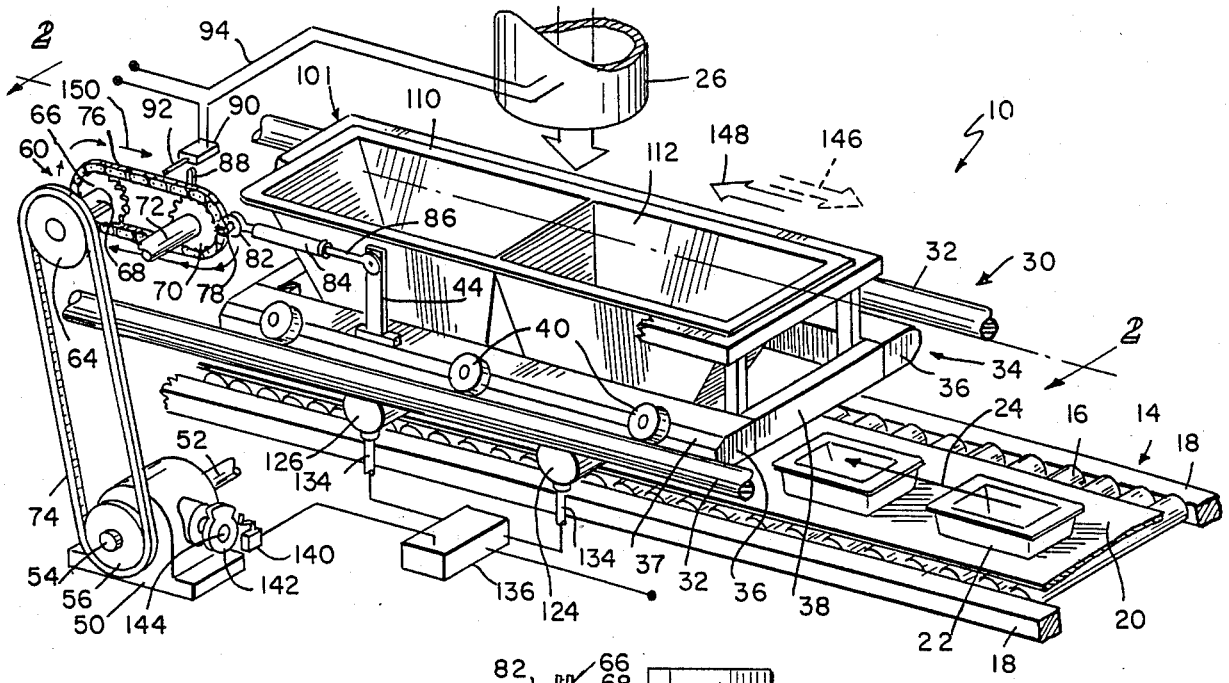
FIG. 1 is a pictorial view of the product feeding and apportioning apparatus and the conveyor system containing the individual receptacles.

Referring now to the drawings, a product apportioning apparatus 10 is shown in FIG. 1 mounted above a conveyor 14. The conveyor 14 includes a plurality of transversely mounted rollers 16, the rollers 16 mounted between two rails 18. A moving belt 20 is supported by the rollers 16 and carries individual receptacles 22 in the direction indicated by arrow 24. A dispensing device 26 is shown above the product apportioning apparatus 10, the use of which will be described later.

Figure 3:
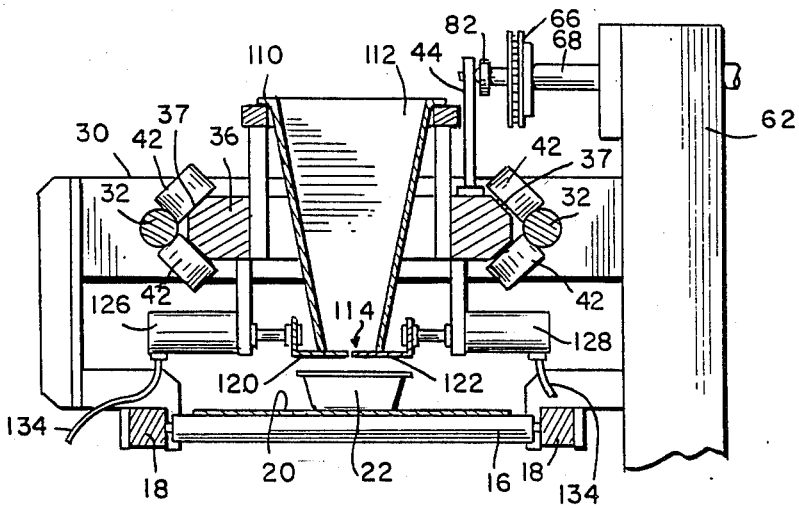
FIG. 3 is a sectional view taken along lines 3—3 of FIG. 2.

The product apportioning apparatus 10 includes a frame 30 (FIGS. 2 and 3) in which two cam rails 32 are mounted. A generally rectangular carriage 34 including two side members 36 and two end members 38 is disposed between the two cam rails 32 (FIG. 1). The outer edges of the side members 36 are beveled at approximately 45° to form beveled faces 37 as best shown in FIG. 3. Cam roller shafts 40 are fixedly attached to, and extend outwardly from, the beveled faces 37. Cam rollers 42 are rotatably mounted on the cam roller shafts 40, with one cam roller 42 mounted on each cam roller shaft 40. The cam roller shafts 40 and associated cam rollers 42 are mounted in pairs with three pairs of cam rollers 42 mounted on each side member 36. Each pair of cam rollers 42 are mounted such that the rolling surfaces of each cam roller 42 in each pair are substantially perpendicular to each other. This arrangement is best shown in FIG. 3. The cam rollers 42 are adapted to engage the parallel rails 32 to allow the carriage 34 to move within the frame 30. Specifically, the carriage 34 is allowed to reciprocally move within the frame 30 guided and supported by the parallel rails 32. Thus, the cam rollers 2 cooperate to rollingly support the carriage 34 on the rails 32. An upright arm 44 is attached to one of the side members 36, the use of which will be discussed later.

To drive the carriage in its reciprocal movement, a drive unit 60 is mounted in the frame 30. Below the drive unit 60, and also located within the frame 30, is a gear box 50. The gear box 50 includes a drive shaft 52 that is driven by a conventional power source (not shown). Illustratively, the drive shaft 52 is driven by the same power source that drives the belt 20. This feature has the advantage that it is easier to time the movement of the carriage 34 with the movement of the belt 20. A shaft 54 extends from the gear box 50 opposite the drive shaft 52. A lower pulley 56 is mounted on the shaft 54 in a conventional manner to allow the lower pulley 56 to rotate with the shaft 54.

The drive unit 60 is mounted in a support 62 (FIGS. 2 and 3) that is attached to the frame 30. The drive unit 60 includes an upper pulley 64 that is aligned with the lower pulley 56 mounted on the gear box 50. The drive unit 60 further includes a drive sprocket 66 in a parallel, spaced apart relation to the upper pulley 64, with a shaft 68 extending therebetween. A second sprocket 70, aligned with the drive sprocket 66, is mounted in the support 62. The sprocket 70 is mounted on a take-up shaft 72 that rotates within the support 62. A chain assembly 76, illustratively a roller chain, is disposed around the drive sprocket 66 and the sprocket 70 to allow the drive sprocket 66 to drive the sprocket 70. A flexible drive assembly 74, illustratively a timing belt, extends around the lower pulley 56 and the upper pulley 64 to allow power from the gear box 50 to drive the drive unit 60.

A chain attachment 78 is attached to the chain assembly 76. A rod end bearing 82 (FIGS. 1 and 2) is journaled to the chain attachment 78. It will be understood that the rod end bearing 82 will follow the chain attachment 78 during the chain assembly's travel around the path definded by the circumference of the drive sprocket 66 and the sprocket 70. A connecting rod 84 is adjustably attached to the rod end bearing 82 at one end of the connecting rod 84 with another rod end bearing 86 attached to the other end of the connecting rod 84. The rod end bearing 86 is then fixedly attached to the upright arm 44 attached to the carriage 34.

It will be understood that as the drive unit 60 is driven by the gear box 50 and flexible drive assembly 74, the chain assembly 76 will rotate about the drive sprocket 66 and sprocket 70. Because the chain attachment 78 is attached to one link of the chain assembly 76, the chain attachment 78 will follow the path of the chain assembly 76. Thus, the connecting rod 84 and rod end bearings 82, 86 will be caused to move in a reciprocating motion as the chain assembly 76 rotates. Because the connecting rod 84 and rod end bearings 82, 86 are directly attached to the carriage 34, the carriage 34 will correspondingly be moved in a reciprocatring manner as the chain assembly 76 rotates. The distance the carriage 34 will move in either direction is generally dictated by the spacing between the drive sprocket 66 and the sprocket 70. Illustratively, in the preferred embodiment, this spacing is approximately 7½ inches. Thus, the carriage 34 will move approximately 7½ inches in either direction.

A finger 88 (FIG. 1) is attached to, and extends outwardly from, the chain assembly 76. An actuating switch 90 having a trip arm 92 is mounted adjacent the chain assembly 76 in a position where the finger 88 will contact the rip arm 92 as the chain assembly 76 rotates about the drive sprocket 66 and sprocket 70. The actuating switch 90 controls an electrical circut 94 which controls the action of the dispensing device 26. The circuit 94 may be powered by any conventional power source, such as a 110 volt or 220 volt power supply (not shown). The circuit 94 controls the dispensing action of the dispensing device 26 which is oriented to periodically fill the product apportioning apparatus 10. Illustratively, when the finger 88 contacts the trip arm 92 of the actuating switch 90, the dispensing device 26 will dispense a specified amount of a particulate product (not shown) into the feeding apparatus 10.

The quantity of particulate product dispensed may be controlled in any of a number of conventional ways, such as by a timing device attached to the actuating switch 90, or by a metering device (not shown) that is part of the dispensing device 26. It will be understood that by positioning the actuating switch 90 and trip arm 92 in a preselected position with respect to the chain assembly 76 and finger 88, the dispensing device 26 can be timed to dispense the particulate material when the reciprocating carriage 34 is in an appropiate position for filling. This feature of the invention will be discussed in more detail later.

Figure 2:
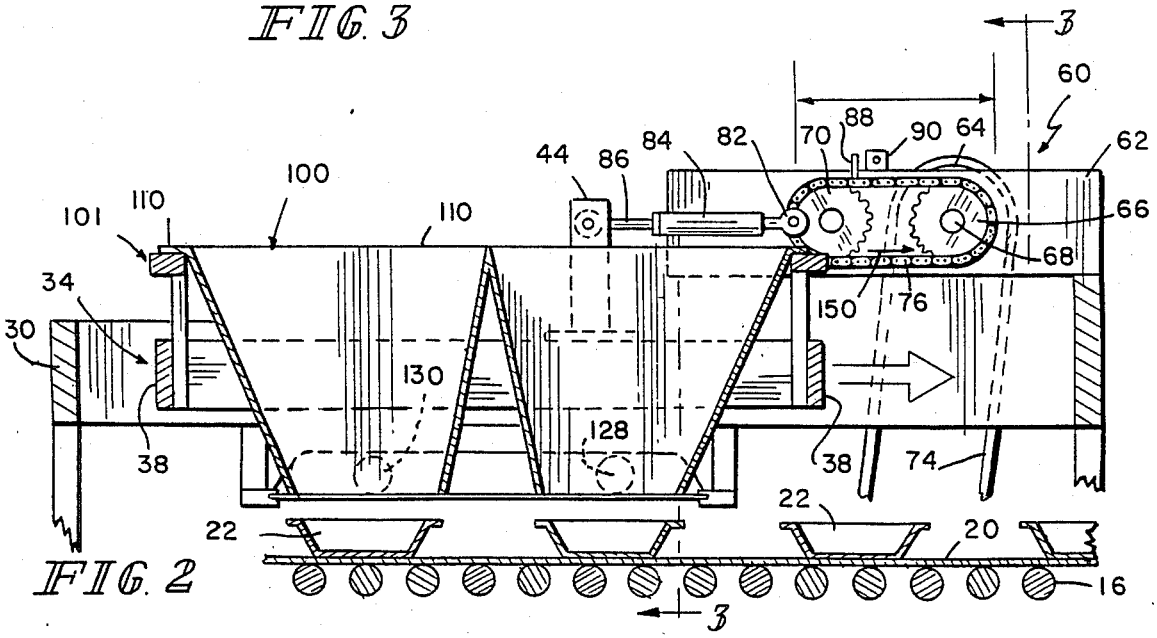
FIG. 2 is a sectional view along lines 2—2 of FIG. 1 of the product feeding and apportioning apparatus and the conveyor system.

A bucket 100 is mounted in a support structure 101 that is attached to the carriage 34 for movement therewith. A second bucket 110 is mounted adjacent the bucket 100 with the buckets 100, 110 generally in an end-to-end relation to each other. As best shown in FIG. 1, both buckets 100, 110 are located within the confines of the carriage 34 and are designed to move with the carriage 34 as it reciprocates. Each bucket 100 , 110 has an inlet opening 112 and an outlet opening 114 (FIGS. 2 and 3). Two opposing blades 120, 122 are used to close the outlet 114 of the buckets 100, 110. The blades 120, 122 are movable from a confronting position (FIG. 3) where the outlet 114 is closed, to a retracted position (not shown) where the outlet 114 is opened.

The blades 120, 122 are moved between the confronting, extended position and the retracted position by air cylinders 124, 126, 128, 130, with cylnders 124, 126 attached to blade 120 and cylinders 128, 130 attached to blade 122. The cylinders 124, 126, 128, 130 are driven by compressed air supplied by air lines 134. The action of the cylinders 124, 126, 128, 130 is controlled by a control unit 136 mounted within the frame 30 which controls and meters the supply of compressed air to the cylinders 124, 126, 128, 130.

The control unit 136 is controlled by an air limit switch 140 (FIG. 1). A cam 142 is mounted for rotation on a jack shaft 144 that extends from the gear box 50. The cam wheel 142 has a raised portion and a recessed portion. As the jack shaft 144 rotates in unison with the drive shaft 52 and shaft 54, the cam wheel 142 will alternately contact an air limit switch 140 mounted adjacent the cam wheel 142. Illustratively, when the raised portion of the cam wheel 142 is in contact with the air limit switch 140, the cylinders 124, 126, 128, 130 will position the blades 120, 122 in the extended position to close the outlet 114 (FIG. 3). When the recessed portion of the cam wheel 142 is aligned with the air limit switch 140, the air cylinders 124, 126, 128, 130 will move the blades 120, 122 to the retracted position to open the outlet 114. It will be understood that because the air limit switch 140 is controlled by the jack shaft 144 from the gear box 50, it is possible to time the movement of the blades 120, 122 to the movement of the conveyor 14 and to the movement of the reciprocating carriage 34.

In operation, the power source (not shown) is turned on which starts the movement of the belt 20 over the rollers 18 to move the receptacles 22 in the direction of arrow 24. The drive shaft 52 is caused to rotate which in turn drives the drive unit 60 through the gear box 50 and the flexible drive assembly 74. The chain assembly 76 and attached connecting rod 84 then move about a path defined by the outer circumference of the drive sprocket 66 and sprocket 70 indicated by arrow 150 (FIG. 1), which in turn moves the carriage 34 and attached buckets 100, 110 in a reciprocating motion. The buckets 100, 110 will thus move in a direction opposite the movement of the receptacles 22, such opposite movement indicated by dotted arrow 146 (FIG. 1). The carriage 34 and buckets 100, 110 will then reverse and move in the same direction as the receptacles 22, such movement indicated by the solid arrow 148 (FIG. 1).

As the buckets 100, 110 move in a direction indicated by dotted arrow 146, the air limit switch 140 will cause the cylinders 124, 126, 128, 130 to move the blades 120, 122 to the extended position to close the outlet 114. At substantially the same time, the actuating switch 90 will be activated by the finger 88 on the chain assembly 76 to activate the dispensing device 26 to cause a preselected amount of particulate material (not shown) to be dispensed into the buckets 100, 110. It will be understood that because the chain assembly 76 rotates in the direction of arrow 150, the buckets 100, 110 will move in the direction of the dotted arrow 146 when the chain attachment 78 and attached rod end bearing 82 are at the top dead center position of the drive sprocket 66 to the top dead center position of the sprocket 70. As the chain attachment 78 then rotates around the sprocket 70, the buckets 100, 110 will reverse direction and the buckets 100, 110 will move in the direction of arrow 148 from the time the chain attachment 78 is at the bottom dead center position on the sprocket 70 to the bottom dead center position on the drive sprocket 66. It will also be understood that the speed of movement of the buckets 100, 110 will be matched to the speed of movement of the belt 20 carrying the individual receptacles 22 by proper selection of the elements of the drive unit 60.

As the filled buckets 100, 110 begin to move in the direction of arrow 148, which corresponds to the direction of movement of the receptacles 22, the air limit switch 140 will direct the control unit 136 to cause the cylinders 124, 126, 128, 130 to move the blades 120, 122 to the retracted position to open the outlet 114 of the buckets 100, 110.

In the preferred embodiment, the individual receptacles 22 will be spaced on the belt 20 to be directly below and aligned with the outlets 114 of the buckets 100, 110. Thus, as the buckets 100, 110 begin to move in tne direction of arrow 148, and the outlets 114 are opened, the particualte product in the buckets 100, 110 will drop into the individual receptacles 22. Illustratively, the outlets 114 are opened from the time the chain attachment 78 is at the bottom dead center position of the sprocket 70 until the chain attachment 78 reaches the bottom dead center position of the drive sprocket 66. At this position, the air limit switch 140 will direct the control unit 136 to move the cylinders 124, 126, 128, 130 to a position where the blades 120, 122 close the outlets 114.

The above-described procedure then repeats itself with the dispensing device 26 then refilling the buckets 100, 110 during their movement in the direction of the dotted arrow 146.

As can be seen, the apparatus of the present invention allows a series of individual receptacles to be filled with a particulate product without the necessity of slowing the receptacles during the filling process.

Although the invention has been described with reference to a preferred embodiment and specific examples, variations and modifications exist within the scope and spirit of the invention as defined in the following claims.

We claim:

1. A product supporting apparatus for depositing a selected amount of a particulate product onto a series of moving receptacles, the apparatus comprising:

means for dispensing a particulate material;

a frame positioned adjacent to the dispensing means;

a carriage located above the moving receptacles;

means for mounting the carriage to the frame to allow reciprocating horizontal movement;

at least one bucket mounted in the carriage having an inlet for receiving the particulate material from the dispensing means and an outlet for depositing selectively the received particulate material onto the moving receptacles;

means for closing the outlet of the bucket so that the received particulate material is retained therein;

means for moving selectively the closing means to open the outlet of the bucket for a specified period of time so that the received material is deposited onto the moving receptacle;

means for reciprocally driving the carriage between a first position where the bucket receives the particulate material and a second position where the bucket deposits the received particulate material onto the moving receptacle;

first means for controlling the speed of movement of the reciprocating carriage such that the speed and direction of the carriage substantially matches the speed and direction of the moving receptacles near the second position; and second means for controlling the means for moving the closing means of the bucket so that the bucket outlet is open when the carriage is in the second position to deposit the particulate material onto the receptacle.

2. The apparatus of claim 1, wherein the means for closing the outlet of the bucket comprises two opposing blades that are movable between a confronting position and a spaced apart position and that cooperate to cover the outlet of the bucket when in the confronting position.

3. The apparatus of claim 2, wherein the means for moving the closing means comprises two air cylinders, with one cylinder attached to one of the blades, respectively.

4. The apparatus of claim 1, wherein the moving receptacles move along an axis and said carriage is oriented for reciprocal movement along said axis.

5. The apparatus of claim 1, further comprising two buckets, both buckets including inlet openings, with the inlet openings mounted contiguous to each other.

6. An apportioning apparatus for depositing a selected amount of a particulate material onto a moving receptacle, the apparatus comprising:

a frame;

a carriage located above the moving receptacles;

means for mounting the carriage to the frame to allow reciprocating horizontal movement;

at least one bucket mounted in the carriage having an inlet for receiving the particulate material and an outlet for depositing selectively the received particulate material onto the moving receptacles;

two bladed attached to said bucket in opposed relation, said blades being movable between a confronting position where said blades cooperate to seal said bucket outlet and a spaced-apart position where said blades cooperate to open said bucket outlet;

a fluid cylinder attached to each blade for moving each blade between the confronting position and the spaced-apart position;

means for reciprocally driving the carriage between a first position where the bucket receives the particulate material and a second position where the bucket deposits the received particulate material onto the moving receptacle;

first means for controlling the speed of movement of the reciprocating carriage such that the speed and direction of the carriage substantially matches the speed and direction of the moving receptacle near the second position; and second means for controlling the air cylinders to open the blades for a specified period of time when the carriage is in the second position to deposit the particulate material onto the receptacle.

7. The apparatus of claim 6, wherein the driving means comprises a revolving chain and a drive arm attached to the chain and to the carriage for movement therewith.

* * * * *

UNITED STATES PATENT AND TRADEMARK OFFICE

CERTIFICATE OF CORRECTION

PATENT NO. : 4,678,015

DATED : July 7, 1987

INVENTOR(S) : Glen F. Raque et al

It is certified that error appears in the above-identified patent and that said Letters Patent is hereby corrected as shown below:

Column 3, line 8, change "rollers 2" to --rollers 42--.

Column 4, line 9, change "rip" to --trip--.

Column 4, line 50, change "cylnders" to --cylinders--.

Column 4, line 59, after "cam", insert --wheel--.

Column 6, line 21 (claim 1), change "supporting" to --apportioning-.

Column 7, line 15 (claim 6), change "bladed" to --blades--.

Signed and Sealed this

Fifteenth Day of December, 1987

*Attest:*

DONALD J. QUIGG

*Attesting Officer*

*Commissioner of Patents and Trademarks*